US005766223A

United States Patent [19]

Johnson

[11] Patent Number: 5,766,223

[45] Date of Patent: Jun. 16, 1998

[54] CHILD'S TEETHING DEVICE

[76] Inventor: Deborah M. Johnson, 5919 Chesnee Dr., Columbia, S.C. 29203

[21] Appl. No.: 621,728

[22] Filed: Mar. 21, 1996

[51] Int. Cl.[6] ..... A61J 17/33

[52] U.S. Cl. ..... 606/235; 606/234; 606/236

[58] Field of Search ..... 606/234, 235, 606/236

[56] References Cited

U.S. PATENT DOCUMENTS

| | | | |
|---|---|---|---|
| 447,164 | 2/1891 | Simpson | 606/235 |
| 1,826,943 | 10/1931 | Maker | 303/235 |
| 2,421,574 | 6/1947 | Newmark | 606/235 |
| 2,514,844 | 7/1950 | Cohen | 606/235 |
| 2,532,116 | 11/1950 | Monaco | 606/235 |
| 2,826,201 | 3/1958 | Yoder | 606/235 |
| 3,669,117 | 6/1972 | Herbst | 606/235 |
| 4,116,202 | 9/1978 | Panicci | 606/235 |
| 5,197,974 | 3/1993 | Scarpelli et al. | 606/235 |

FOREIGN PATENT DOCUMENTS

| | | | |
|---|---|---|---|
| 117636 | 10/1942 | Australia | 606/235 |

*Primary Examiner*—Michael Buiz
*Assistant Examiner*—Daphna Shai
*Attorney, Agent, or Firm*—B. Craig Killough

[57] ABSTRACT

A teething device having an uneven surface of resilient material. A portion of the teething device contains a material which is liquid at room temperature, and which is frozen at a temperature below the normal operating temperature of a household freezer. Sound producing members are provided which produce noise as the device is moved about. Annular rings are provided for gripping and holding the device.

4 Claims, 1 Drawing Sheet

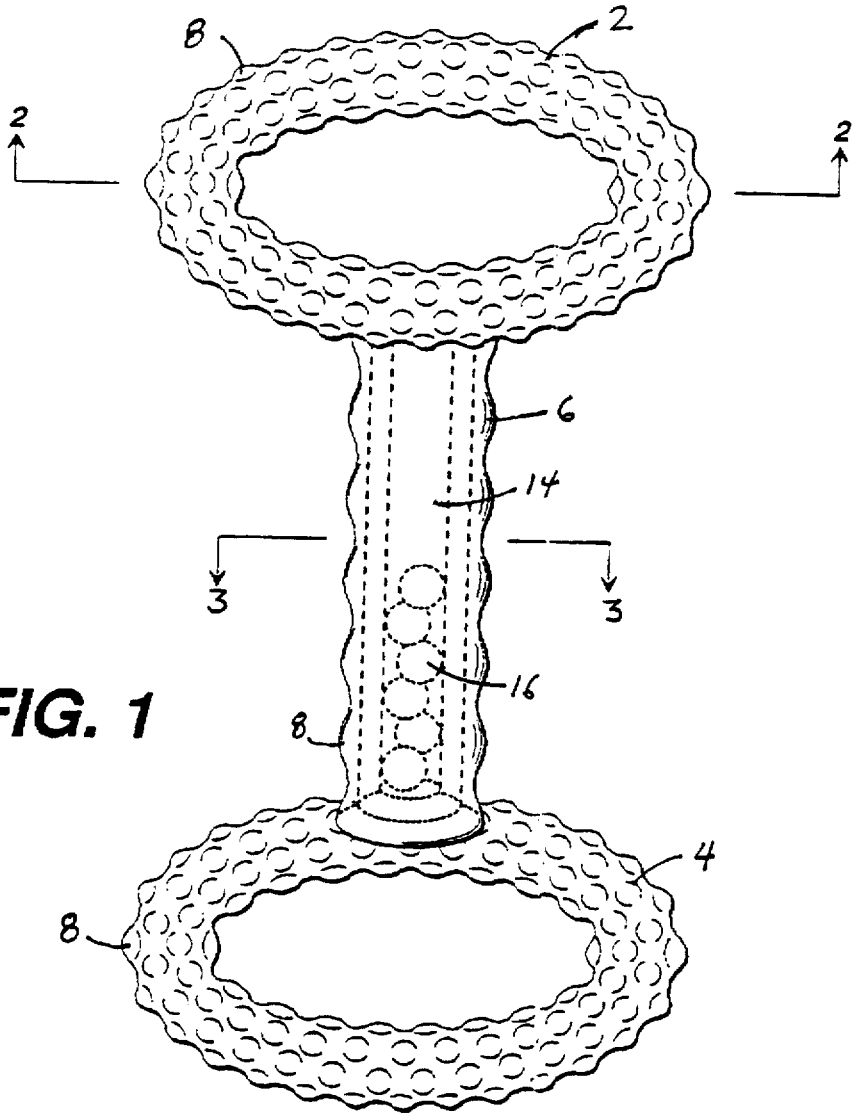
FIG. 1
FIG. 2
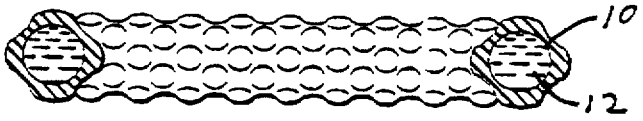
FIG. 3
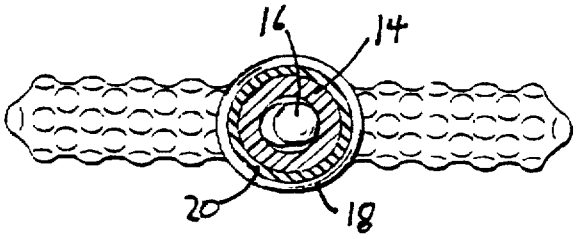

CHILD'S TEETHING DEVICE

FIELD OF THE INVENTION

This invention relates to teething devices for infant children.

BACKGROUND OF THE INVENTION

It is known to be therapeutic for an infant who is developing teeth, or "teething," to use a resilient device, such as rubber, to massage the gums during the teething process. The use of such teething devices facilitates the eruption of the teeth through the gums, while also soothing the gums and reducing pain which is associated with teething.

SUMMARY OF THE PRESENT INVENTION

The present invention provides a teething device of formed of a resilient material and having an uneven surface. A portion of the teething device contains a material within the device which is liquid at room temperature, but which may be frozen by means of placing the teething device in a household freezer. A sound producing feature, such as a rattle, is provided in another portion of the device.

The uneven surface, which may be a multiplicity of nodules, aids in massaging the gums. The freezable material transfers a cold temperature to the gums which acts as an anesthetic to reduce the pain to the gums. The rattle, or sound producing feature of the device, acts to divert the infant child's attention to the rattle and away from the pain experienced with the teething process. The device is formed so that it is easily retained within the hand of the infant.

DESCRIPTION OF THE DRAWINGS

FIG. 1 is a perspective view of the device.

FIG. 2 is a section view of the device taken essentially along line 2—2.

FIG. 3 is a sectioned view of the device taken essentially along line 3—3.

DETAILED DESCRIPTION OF THE PREFERRED EMBODIMENT

Referring now to the drawing figures, FIG. 1 shows the device as having a first end 2, a second end 4, and a central member 6. The first end is of a resilient material, such as a soft rubber. The resilient material is non-toxic, and is easily sanitized. The resilient material is a material which is suitable for oral use by an infant child. The resilient material easily deflects upon normal pressure applied to the material by an infant chewing on the device. The resilient material may be a covering over a harder support structure such as plastic.

The first end is preferred to have an uneven surface. The uneven surface may be produced by raised nodules 8 as shown in the drawing figures. The raised nodules have the effect of improving the massaging function of the device.

A portion of the device is provided with a void. The portion of the device containing the void may be the second end, as shown in the drawing figures, which is opposite the first end. As shown, the second end is similar in structure to the first end, and is comprised of a resilient material having an uneven surface formed by raised nodules. The void 10 is preferred to be an annular void which is contained within, and which may be concentric with, the annular second end.

The void contains a material 12 which is liquid at room temperature. The material is capable of being frozen by placing the device within a normal household freezer. The material may be water or other materials which can be chilled or frozen. The material could be a liquid freezable material which is commonly sold for use as ice packs. This liquid freezable material is liquid at room temperature, but is capable of being frozen by normal household refrigerators, and resists thawing in a manner which is superior to water. The material is preferred to have minimal volumetric differences when frozen as compared to the liquid state, that is, the expansion and contraction of the material should be minimal during thermal change. It is noted that the resilient material has relatively good insulation properties, but allows heat to be transferred from the child.

The portion of the device which does not have the freezable material, which is shown as the first end, may be connected to the portion of the device having the freezable liquid, which is shown as the second end, by the central member 6. The central member may have an uneven surface, or nodules 8, and may be resilient.

A portion of the device functions as a sound making device, such as a rattle. The rattle may be formed within the elongated central member. The rattle may be formed by a longitudinal void 14 within the central member in which balls 16 are placed, or in which bells or other noise-producing objects are located. The balls or other noise producing objects traverse the void, and by contacting the sides of the void, or each other, produce a noise. The central member, as shown in FIG. 3, may be comprised of a resilient material 18, or a resilient material which covers a harder material 20, such as a hard plastic. The balls or other noise-producing devices will then rattle against the harder walls to produce a noise.

The first end and the second end may have an oval or other annular shape. It is preferred that a void is formed within the annular ends to produce rings. The annular rings produce a "hand hold" for the device, meaning that the device may easily be held by an infant child by insertion of the fingers through the void. An oval ring shape as shown is particularly well suited for grasping and holding the device by the infant. The elongated central member is of sufficient length to allow an infant to grasp the central member, with the enlarged ends helping to retain the hand on the central member. The resilient nature of the exterior of the device, along with the nodules, also makes the device easy to grip and hold, even when the device is lubricated from the presence of saliva. As shown in FIG. 1, the central member or longitudinal handle is attached at each end to an oval or elliptical teething ring. The longitudinal handle is attached at a side of the elliptical teething rings where the ellipse is of relatively a large radius, so that the handle cannot be inserted too far into the child's mouth. The narrower portion of the ellipse cannot be inserted too far into the child's mouth, since the handle will aid in preventing such insertion. The other side of the ellipse is relatively wide, preventing the device from being inserted too far into the child's mouth.

The invention produces a teething device which is superior to those known in the prior art. The resilient and uneven surface provides an excellent surface for massaging the gums, while the chilled liquid aids in relieving pain at the gums of the infant. At the same time, only a portion of the device has a reduced temperature, so that the infant may quickly and easily grasp other portions of the device to avoid the cold. The rattle or noise-producing device aids in distracting the infant, thereby taking the infant's attention away from the pain associated with the teething process. The overall shape of the device, with the use of annular rings at each end, and the central member, along with raised nodules and the resilient surface, make a device which is easy to grip and hold.

What is claimed is:

1. A child's teething device, comprising:

an elliptical teething ring having a multiplicity of raised nodules on an exterior surface thereof, wherein said exterior surface of said elliptical teething ring is formed of resilient material, said elliptical teething ring has an enclosed void therein, and wherein a freezable material is contained within said enclosed void which is liquid at room temperature;

a rigid longitudinal handle which is attached at one end to said elliptical teething ring at a side of said elliptical teething ring where the ellipse is of relatively large radius, wherein said rigid longitudinal handle is non-metallic and does not contain a freezable material which is liquid at room temperature, and wherein said rigid longitudinal handle has a central void therein; and a second elliptical teething ring which is attached to said rigid longitudinal handle at an opposite end of said rigid longitudinal handle from said first elliptical teething ring, and said second elliptical teething ring has a multiplicity of raised nodules on an exterior surface thereof, and said exterior surface of said second elliptical teething ring is formed of resilient material.

2. A child's teething device as described in claim 1, wherein said second elliptical teething ring has an enclosed void therein, and wherein a freezable material is contained within said enclosed void which is liquid at room temperature.

3. A child's teething device, comprising:

a first teething ring having a multiplicity of raised nodules on an exterior surface thereof, wherein said exterior surface of said first teething ring is formed of resilient material, said first teething ring has an enclosed void therein, and wherein a freezable material is contained within said enclosed void which is liquid at room temperature;

a rigid longitudinal handle which is attached to and extends from said first teething ring, wherein said rigid longitudinal handle is non-metallic and does not contain a freezable material which is liquid at room temperature, and wherein said rigid longitudinal handle has a central enclosed void therein; and, a second teething ring which is attached to said rigid longitudinal handle opposite said first teething ring, said second teething ring having a multiplicity of raised nodules on an exterior surface thereof, wherein said exterior surface of said second teething ring is formed of resilient material.

4. A child's teething device as described in claim 3, wherein each of said first teething ring and said second teething ring are elliptically shaped.

* * * * *